United States Patent [19]

Gunther

[11] 3,990,195

[45] Nov. 9, 1976

[54] HUB FOR GEODESIC DOME FRAMEWORK CONSTRUCTION

[76] Inventor: Robert Reeves Gunther, P.O. Box 842, Santa Cruz, Calif. 95061

[22] Filed: Feb. 18, 1975

[21] Appl. No.: 550,856

[52] U.S. Cl. ..... 52/81; 403/175

[51] Int. Cl.[2] ..... E04B 1/32

[58] Field of Search ..... 52/80, 81, 82, DIG. 10; 403/175, 171, 172, 174, 178, 176

[56] References Cited

UNITED STATES PATENTS

| | | | |
|---|---|---|---|
| 1,495,565 | 5/1924 | Yorke | 403/174 |
| 2,936,530 | 5/1960 | Bowen | 403/171 |
| 3,002,590 | 10/1961 | Hanroosh | 52/81 |
| 3,061,977 | 11/1962 | Schmidt | 52/81 |
| 3,114,176 | 12/1963 | Miller | 52/81 |
| 3,186,522 | 6/1965 | McCauley | 52/81 |
| 3,344,565 | 10/1967 | Nye | 52/81 |
| 3,486,278 | 12/1969 | Woods | 52/81 |
| 3,530,621 | 9/1970 | Rutzebeck | 52/81 |
| 3,688,461 | 9/1972 | Rensch | 403/174 |
| 3,810,342 | 5/1974 | Scott | 52/81 |
| 3,844,074 | 10/1974 | Ahern | 52/81 |

OTHER PUBLICATIONS

Dome Book 2, p. 117, C. 1971. Art Unit 354.

Dome Book 2, pp. 109, 111, 112, C. 1971.

*Primary Examiner*—Price C. Faw, Jr.

*Assistant Examiner*—Henry Raduazo

[57] ABSTRACT

A hub for use in the construction of the framework of geodesic domes is described. The hub is formed from a plurality of flat generally rectangular leg plates rigidly joined at one end of each plate so that the leg plates extend radially from the junction and are so arranged that the angle between adjacent leg plates is at least 50 degrees. Each leg plate has at least two openings through its side wall sized to receive clamping means such as bolts to permit attachment of the leg plate to one of the struts making up the framework of the dome.

2 Claims, 5 Drawing Figures

HUB FOR GEODESIC DOME FRAMEWORK CONSTRUCTION

BACKGROUND OF THE INVENTION

Structures of the kind now commonly referred to as geodesic domes were described by Richard Buckminster Fuller in U.S. Pat. No. 2,682,235 which issued about twenty years ago. The general character of geodesic dome construction and many illustrations of geodesic domes are set out in Robert W. Marks' book titled "The Dymaxion World of Buckminster Fuller," Southern Illinois University Press, 1960.

In the early use of geodesic dome construction, large domes built to house exhibitions and displays attracted considerable attention and received a great deal of publicity. Smaller domes built in this period were mainly for military use and were not much publicized.

More recently, geodesic dome construction has been extensively employed in the erection of greenhouses of varying sizes, for example, by Redwood Domes of Santa Cruz, California. Still more recently, the great strength and low construction costs of geodesic domes has persuaded a number of people that a house does not have to be a box and has led to their introduction in housing construction. While geodesic domes have won some acceptance in housing construction, a considerable outlay in man hours is required for the erection of the framework of the dome when the construction techniques currently available are followed. A substantial reduction in this man hour outlay would assist in overcoming the public predilection toward box housing and would facilitate wider acceptance of the geodesic dome technique in the construction of homes and so would incidentally but importantly provide a means for meeting the growing need for low cost housing.

BRIEF DESCRIPTION OF THE INVENTION

The framework of a geodesic dome is a network of interconnected struts which define a portion of a convex polyhedron. The struts are commonly so connected that the framework of the dome appears as a network of triangles so arranged that each side of each triangle abuts a side of an adjacent triangle, the abutting sides being of equal length. It is inherent in this network of triangles that each vertex of each triangle meets the vertices of several other triangles. It is at the common vertex points that the struts constituting the framework must be anchored. To accomplish the necessary anchoring of the struts, a hub is placed at each common vertex. The hub consists of a plurality of generally rectangular leg plates rigidly joined at one end of each leg plate so that the plates extend radially from the junction, each leg plate has at least two generally circular holes or slots cut through the plate body at points between the junction and the end of the plate with the angle between adjacent leg plates being at least 50 degrees, the precise angle being dependent upon the number and shape of the triangles sharing the common vertex. The struts are bolted to the hubs as more fully described hereinafter. Joining of the leg plates may be accomplished by welding them together, or to a central tube or rod, or by casting the assembly so that one end of each leg plate terminates at the center of the casting.

Figure 4:
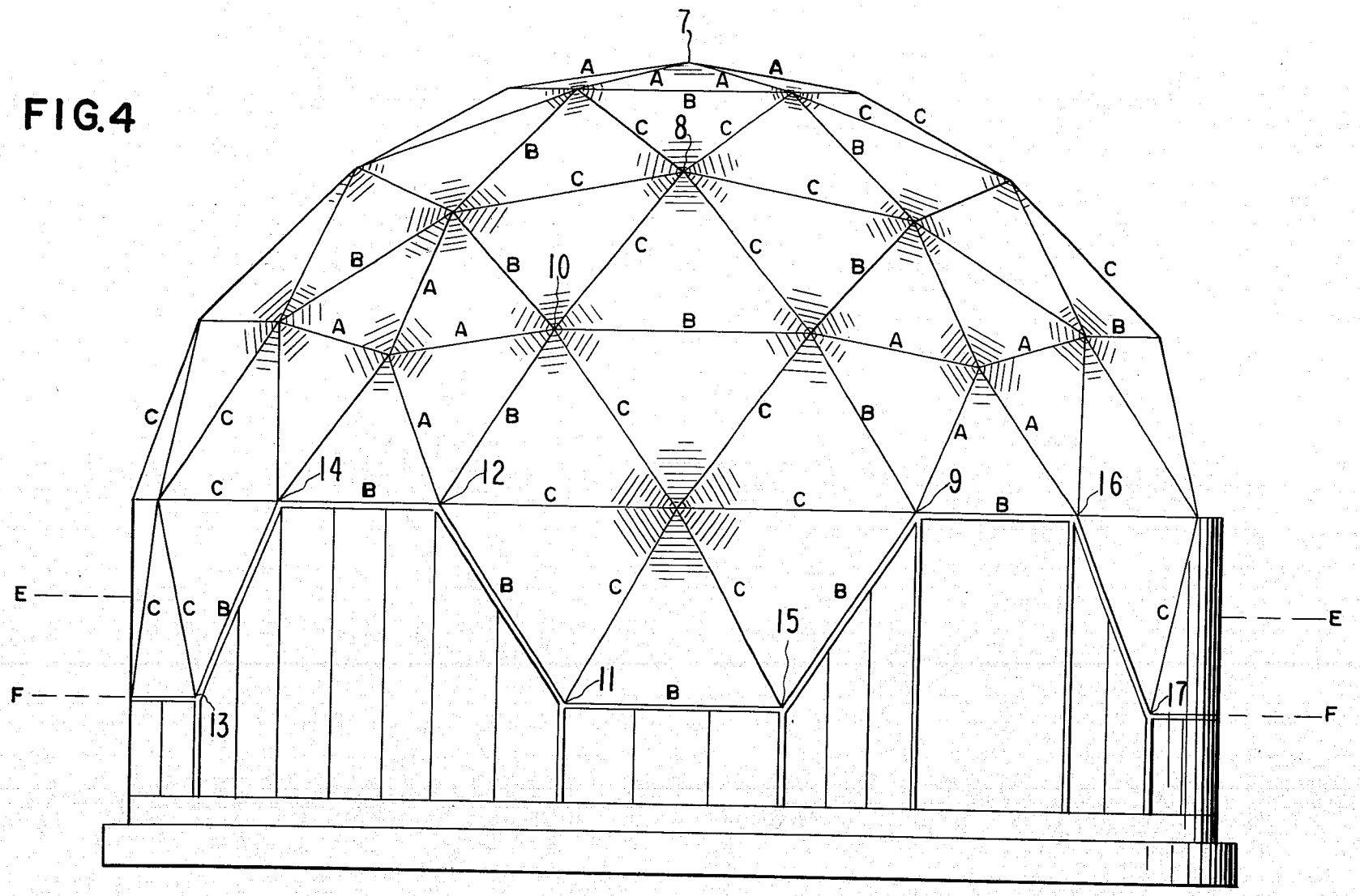
FIG. 4 is an elevation of the dome.

Geodesic domes have been based on regular polyhedrons such as rhombic triacontahedron, the dodecahedron and the icosahedron. FIG. 4 of the drawing shows a dome based on a three frequency icosahedron, i.e., each of the twenty triangles forming the surface of the icosahedron is divided into nine triangles formed by two lines parallel to each side of the triangle and spaced so that the altitude on each side is divided into three equal segments. The spacial arrangement of the nine triangles is convex in the sense that all of the common vertices touch the surface of the sphere which would enclose the icosahedron.

In order to facilitate understanding of the structure, the drawings will be described with reference to a dome based on a three-frequency icosahedron and having a diameter of 30 feet.

Figure 1:
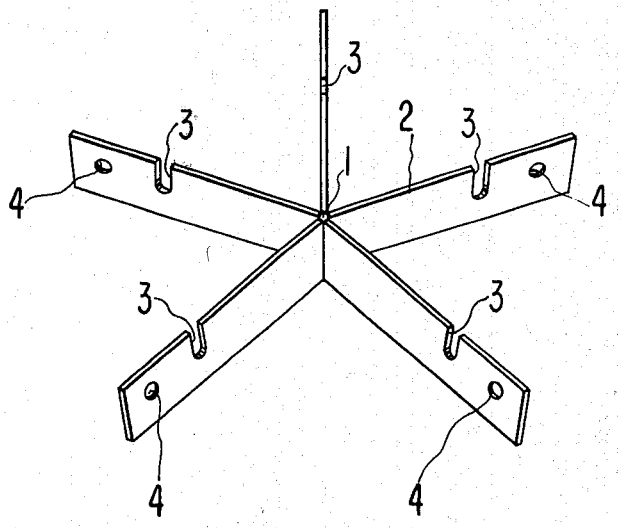
FIG. 1 is an elevation of the hub.

FIG. 1 is an elevation of the hub. Specifically, it illustrates the hub 7 shown in FIG. 4 as the topmost hub of the dome. The several leg plates 2 are metal plates about 8 inches in length, 2 inches in height and ⅛ inch thick. In this case the plates are rigidly attached to central rod 1 which is a metal rod about ⅜ inch in diameter and 2 inches in height. The leg plates may be welded together or to the central rod, or the entire hub may be cast to provide the rigid engagement between the leg plates at the center of the casting. A slot 3 is cut out of each leg plate and extends from the upper edge of the plate to about the plate's center. The slot width is about ½ inch. At least one circular hole 4 is cut through each leg plate at a point intermediate the slot 3 and the outer edge of the plate 5. The diameter of this hole is about ½ inch. If desired, a generally circular hole through the plate may be substituted for slot 3. The slotting arrangement is preferred because its use facilitates bolting of the struts which make the framework of the dome (A, B and C shown in FIG. 4) where the first bolt must be attached so close to the center of the hub.

Figure 2:
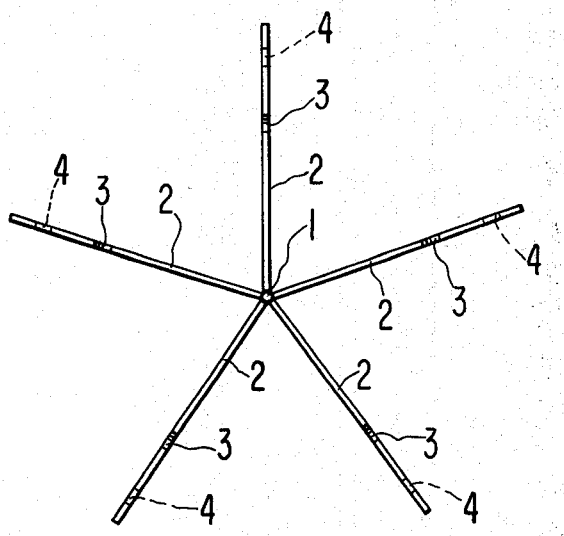
FIG. 2 is a plan view of the hub.

FIG. 2 is a plan view of the hub showing the several leg plates extending radially from the central rod 1 and so arranged that the angle between each pair of adjacent leg plates is 72° measured from the midpoint of one leg plate to the midpoint of the adjacent leg plate.

Figure 3:
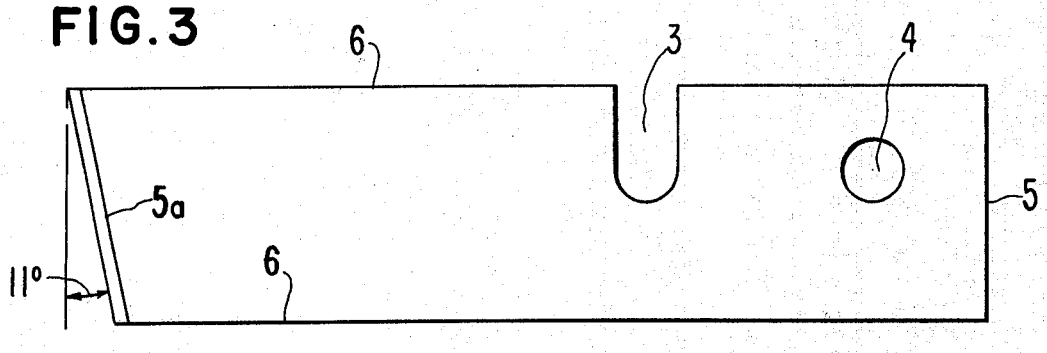
FIG. 3 is an elevation of one of the leg plates of the hub.

FIG. 3 is an elevation of the leg plate. The leg plate has the shape of a right trapezoid, one of the width edges of the plate being inclined to the vertical at an angle of 11° as shown in the drawing. It is the inclined width edges of the plate that are rigidly bonded to central rod 1. This inclination of the several leg plates to the central rod gives the total hub a slightly conical character. While the leg plates are conveniently right trapezoidal, it is only important that edge 5*a* be at an angle to long edges 6, end 5 is conveniently but not necessarily perpendicular to long edges 6.

FIG. 4 of the drawing is an elevation of the dome. The letters A, B and C are the struts which make up the framework of the dome. They are preferably about 2 inch by 4 inch wooden struts but could be made from metal, preferably a light metal, if desired. In the 30 foot dome which is being described for purposes of illustration, struts A would be approximately 5 feet long, struts B approximately 6 feet long and struts C approximately 6 feet, 1 inch long. Points 7, 8, 9, 10, 11, and 12 identify the six types of common vertex points where the vertices of several triangles meet. Each of these six types of common vertex require hubs having specific angles between adjacent leg plates to which the struts are bolted.

All of the struts radiating from point 7 are A-type struts and the angles between all pairs of adjacent leg plates are 72°. All struts radiating from point 8 are C-type struts of which there are six, the angle between each adjacent pair of struts is 60°. Clockwise about point 9, the strut sequence is B, C, B, A, B. Clockwise the angles between the adjacent struts are 62°, 62°, 56°, 56°, and 124°. Clockwise about point 10, the strut sequence is A, B, C, B, C, B and clockwise the angles between adjacent struts are 56°, 62°, 62°, 62° and 56°. Clockwise about point 11, the strut arrangement is B, C, B and clockwise the angles between adjacent struts are 62° and 62°. In the case of a ⅜ths dome, the hub at the point corresponding to point 11 in the ⅝ths dome has angles of 56° between the adjacent leg plates.

Clockwise about point 12, the strut arrangement is B, A, B, C, B and the angles between adjacent struts clockwise are 56°, 56°, 62°, 62° and 124°. All of the other common vertex points from which the struts making up the framework of the dome radiate will be identical with one or another of the arrangement shown for points 7, 8, 9, 10, 11 and 12. Accordingly, the framework of the dome is constructed using six hub types and three strut lengths.

The line E—E indicates the position of the equator of the dome and the line F—F indicates the ⅝ths parallel of the dome. In a preferred embodiment of the dome construction, the lower extremity of the dome framework lies along the ⅝th parallel.

The dome is supported by floor 18 which may be a concrete slab or a wooden floor supported by a conventional foundation. A low wall 19 rises vertically from the floor to receive the dome. The wall is staggered to receive the lower extremity of the dome framework and the upper face of the vertical wall has the shape obtained by joining points 13, 14, 12, 11, 15, 9, 16 and 17 etc., as shown in FIG. 4. A door is conveniently placed in one of the taller sections of the vertical wall, e.g. in the portion of the section lying between points 9 and 16 as shown in FIG. 4.

After the dome framework has been erected, the dome is enclosed by affixing triangular panels to the struts which form the sides of the triangles. The triangular panels are conveniently plywood and any desired triangle or triangles can be covered by triangular glass panels to provide any desired window arrangement.

Figure 5:
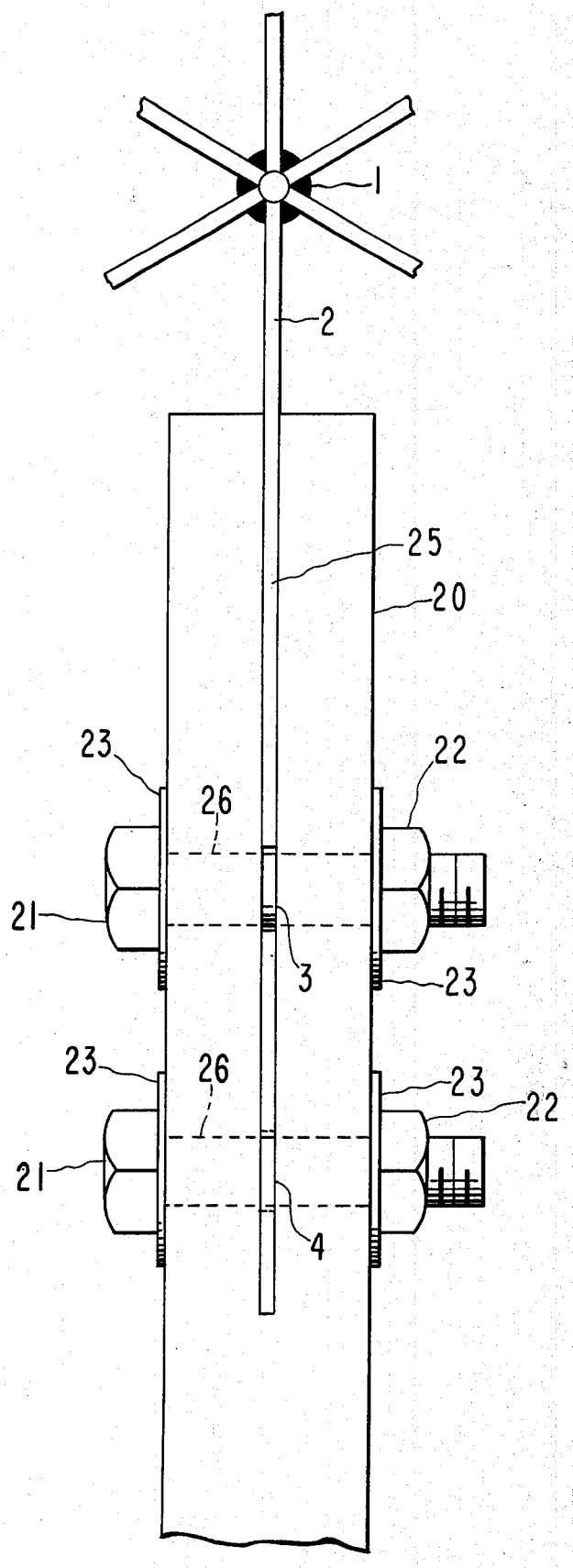
FIG. 5 is a plan view of the hub-strut connection.

FIG. 5 shows a cut-away of the hub strut attachment. Strut 20 is conveniently a two inch by four inch wooden strut. The strut has a slot 25 cut into each end. The width of the slot is adapted to receive a leg plate in close fit and the length of the slot is adjusted to receive the main length of the leg plate. Two holes 26 are bored through the width of the strut and are spaced so that they come into alignment with slot 3 and hole 4 of the leg plate. Bolts 21 are passed through the strut and leg plate and nuts 22 overlaying washers 23 are tightened to make a firm connection between the strut and the leg plate.

It will be noted that bolts 21 are aligned parallel to the floor of the dome so that neither the bolthead nor the nuts protrude from the strut into the interior of the dome with the result that laying on the exterior triangular panels and covering the interior surface of the dome can be carried out without the need to accommodate the difficulties which protruding boltheads or nuts would create.

The dome structure described in detail above is a three-frequency icosahedron dome 30 feet in diameter in which the lower portion of the dome which rests on the low part of wall 19 at the ⅝ths parallel of the dome, i.e., the intersection of a plane parallel to floor 18 and perpendicular to a dome diameter extending downwardly from point 7, the apex of the dome.

In another embodiment of the dome, the dome will meet the lower portions of wall 19 along the ⅜ths parallel of the dome. When the ⅜ths dome is also a 30 foot diameter dome, no change in strut lengths is required but one change in hub type is required, i.e., instead of the B, C, B hub at point 11, a B, A, B hub having angles of 56° between adjacent leg plates must be used.

Domes of 20 feet or 40 feet diameter may be constructed using the same hub patterns but using shorter struts in the case of the 20 foot dome and longer struts in the case of the 40 foot dome.

The same hub principle is used when domes based on either the rhombic triacontahedron on the pentagonal dodecahedron are constructed. The angles between adjacent leg plates will differ, however, from those described in detail above, but all of the angles between adjacent leg plates will be at least 50°.

The hub structure of the present invention makes possible very rapid erection of the dome framework. For example, after the supporting wall is set in place, one man can erect the entire framework of a 30 foot dome in 6 hours.

For the construction of a 30 foot ⅝ths dome, 56 hubs are required, 10 for B, C, B vertices, 5 for B, A, B, C, B vertices, 5 for B, C, B, A, B vertices, 6 for A, A, A, A, A vertices, 10 for C, C, C, C, C vertices and 20 for A, B, C, B, C, B vertices.

The hubs, struts and panels required for the construction of the dome can be prefabricated, color coded to facilitate placement, packaged and shipped to do-it-yourself builders. The total weight of the materials required for a 30 foot ⅝ths dome is 3,600 pounds. The triangular panels in this kit are ½ inch plywood and, or course, some of the triangular panels are framed glass to provide window space. The total weight of a comparable kit but for a 20 foot ⅝ths dome is 1,800 pounds. The total weight of kits for the erection of ⅜ths domes are smaller being about 1,200 pounds for a 20 foot ⅜ths dome and 2,400 pounds for a 30 foot ⅜ths dome. There is some variation in weight because of variation in the density of the wood constituting the struts and panels so that the above weights are close approximations.

What is claimed is:

1. A kit useful in constructing the framework of geodesic domes comprising a. a hub comprising at least 3 thin, flat, generally rectangular leg plates extending radially from a central junction at which one width end of each leg plate is rigidly joined with one width end of each of the other leg plates so that the width ends coincide, each leg plate having at least two generally circular holes passing through the plate body at points between the junction and the outer end of the plate, the angle between adjacent leg plates being at least 50° and the leg plates being so arranged that the width side of each plate communicating with the central junction is at an angle of 2° to 12° to the perpendicular to the long sides of the plate, and b. a plurality of elongated wooden struts, each strut being slotted at each end with slots sized to receive a leg plate of the hub.

2. A kit useful in constructing the framework of geodesic domes comprising:

a. a plurality of hubs, each hub comprising at least three thin, flat, generally rectangular leg plates extending radially from a central junction at which one width end of each leg plate is rigidly joined to one width end of each of the other leg plates so that the width ends coincide, each leg plate having at least two generally circular holes passing through the plate body at points between the junction and the outer end of the plate, the angle between adjacent leg plates being at least 50° and the leg plates being so arranged that the width side of each plate communicating with the central junction is at an angle of 2° to 12° to the perpendicular to the long sides of the plate, and b. a plurality of elongated wooden struts, each strut being slotted at each end with slots sized to receive a leg plate of the hub and having two generally circular holes passing through the slotted ends of the strut perpendicular to the slot and spaced apart from each other so that they will be in register with the circular holes of the leg plates when the leg plates are fitted into the slots.

* * * * *